US005328788A

United States Patent [19]

Omote et al.

[11] Patent Number: 5,328,788

[45] Date of Patent: * Jul. 12, 1994

[54] ORGANIC PHOTOCONDUCTIVE MATERIAL FOR ELECTROPHOTOGRAPHY AND METHOD FOR MAKING THE SAME

[75] Inventors: Atsushi Omote, Kawasaki; Sohji Tsuchiya, Tsukui; Mutsuaki Murakami, Tokyo, all of Japan

[73] Assignee: Matsushita Electric Industrial Co., Ltd., Osaka, Japan

[ * ] Notice: The portion of the term of this patent subsequent to Feb. 11, 2009 has been disclaimed.

[21] Appl. No.: 735,724

[22] Filed: Jul. 25, 1991

[30] Foreign Application Priority Data

Jul. 26, 1990 [JP] Japan ..... 2-200534
Jul. 27, 1990 [JP] Japan ..... 2-199402

[51] Int. Cl.[5] ..... G03G 5/047

[52] U.S. Cl. ..... 430/57; 430/58; 430/78; 430/135

[58] Field of Search ..... 430/57, 58, 78, 135

[56] References Cited

U.S. PATENT DOCUMENTS 3,357,989 12/1967 Byrne et al. .
4,933,248 6/1990 Lind et al. ..... 430/83
5,087,540 2/1992 Murakami et al. ..... 430/58

FOREIGN PATENT DOCUMENTS 0058084 8/1982 European Pat. Off. .
0408380 1/1991 European Pat. Off. .
63-142356 6/1988 Japan .
162648 3/1989 Japan .

OTHER PUBLICATIONS

Masafumi Ota, "Bathochromic Shifts of Azo-Pigments as Electrophotographic Photoconditions", Ricoh Technical Report No. 8, Nov. 1982, pp. 14–18.

*Primary Examiner*—Marion E. McCamish
*Assistant Examiner*—Mark A. Chapman
*Attorney, Agent, or Firm*—Lowe, Price, LeBlanc & Becker

[57] ABSTRACT

A method for making photosensitive materials of the positive charge type which are useful in electrophotography is described. In the method, X-type and/or $\tau$-type phthalocyanine is at least partially dissolved in a solvent along with a resin binder or in a solution of the resin binder by which good photosensitive characteristics are obtained. The photosensitive material obtained by the method may be of a single-layer or a double-layer type. A photosensitive material having an improved ozone resistance is also disclosed. The material makes use of a resin binder having vinylphenol units therein.

23 Claims, No Drawings

ORGANIC PHOTOCONDUCTIVE MATERIAL FOR ELECTROPHOTOGRAPHY AND METHOD FOR MAKING THE SAME

BACKGROUND OF THE INVENTION

1. Field of the Invention

This invention relates to the art of electrophotography and more particularly, to a method for fabricating photosensitive materials for electrophotography which make use of organic photosensitive compounds and are particularly suitable for use in electrophotography for positive charge systems. The invention also relates to photosensitive materials which are particularly resistant to ozone with high durability.

2. Description of the Prior Art

Electrophotographic photosensitive materials can be broadly classified into two groups. One group makes use of inorganic photoconductors as a photosensitive material. Typical of the inorganic photoconductors are selenium, zinc oxide, titanium oxide, cadmium sulfide and the like. Another group makes use of organic photoconductors such as phthalocyanine pigments, disazo pigments and the like.

In the photosensitive materials using the inorganic photoconductors, the thermal stability and durability are not necessarily satisfactory. In addition, some inorganic photoconductors are disadvantageous in the toxicity thereof, presenting problems on fabrication and handling.

On the other hand, the photosensitive materials using organic photoconductors have a number of advantages over inorganic photosensitive compounds, including the ease in preparation of a variety of compounds exhibiting high sensitivity at different wavelengths depending on the molecular design, little or no ecological problem, and good productivity and economy. Although the problems hitherto involved in organic photosensitive materials include those of durability and sensitivity, these characteristic properties have been remarkably improved at present. Some organic photoconductors have now been in use as main photosensitive materials for electrophotography.

Known organic photosensitive materials usually have a double-layer structure which includes a charge generation layer capable of absorbing light to generate carriers and a charge transport layer wherein the generated carriers are transported. Known materials used to form the charge generation layer include perylene compounds, various phthalocyanine compounds, thia pyrylium compounds, anthanthrone compounds, squalilium compounds, bisazo compounds, trisazo pigments, azulenium compounds and the like.

On the other hand, the materials used to form the charge transport layer include various types of hydrazone compounds, oxazole compounds, triphenylmethane compounds, arylamine compounds and the like.

There is now a high demand of photosensitive materials for recording such as by laser printers wherein the organic photosensitive compounds indicated above are used in a near ultraviolet range corresponding to semiconductor laser beams with a wavelength range of from 780 to 830 nm. Accordingly, organic photosensitive compounds having high sensitivity in the above-indicated near ultraviolet range have been extensively studied and developed. In view of the sensitivity in the above UV range, organic photosensitive compounds are more advantageous than inorganic photosensitive metals or compounds.

The organic photosensitive compounds are usually employed in combination with binder resins and applied onto substrates, such as drums, belts and the like, by relatively simple coating techniques. Examples of the binder resins used for this purpose include polyester resins, polycarbonate resins, acrylic resins, acryl-styrene resins and the like. In general, with the double-layer structure, the charge generation layer is coated in a thickness of several micrometers in order to attain high sensitivity and the charge transport layer is applied in a thickness of several tens of micrometers. From the standpoint of the physical strength and the printing resistance, the charge generation layer should generally be formed directly on the substrate and the charge transport layer is formed as a surface layer. In this arrangement, charge transport compounds which are now in use are only those which act by movement of positive holes. Thus, the known photosensitive materials of the double-layer structure are of the negative charge type.

The negative charge systems, however, have several disadvantages: (1) negative charges used for charging attack oxygen in air into ozone; (2) charging does not proceed satisfactorily; (3) the system is apt to be influenced by surface properties of a substrate such as a drum. Ozone presents the problem that not only ozone is harmful to human bodies, but also it often reacts with organic photosensitive compounds to shorten the life of the photosensitive materials.

In order to solve the above problems, organic photosensitive materials of the positive charge type have been extensively studied. In order to realize the positive charge systems, attempts have been heretofore made including (1) reversed double-layer structures wherein the charge generation layer and the charge transport layer are reversed to the case of the negative charge type; (2) single-layer structures wherein various types of charge generation compounds and charge transport compounds are dispersed in binder resins; and (3) a single-layer structure wherein copper phthalocyanine is dispersed in polymers.

However, the reversed double-layer structure involves the problems similar to the negative charge system, i.e. complicated fabrication processes and the separation of the two layers. In addition, the charge generation layer, which has to be substantially thin, is placed on the surface of the photosensitive material with attendant problems such as reduction in the printing resistance and a poor life characteristic.

On the other hand, the photosensitive materials having the single-layer structure as in (2) and (3) above which are of the positive charge type are inferior to the double-layer structure photosensitive materials with respect to the sensitivity and charge characteristics, i.e. the materials are less likely to be charged, and a great residual potential. The reason why the sensitivity is poorer is that the generation and transport of charges take place randomly in the single layer. Thus, the photosensitive materials having the single-layer structure has the problem to solve when used in practical applications. It will be noted, however, that the single structure as in (2) and (3) above is advantageous in that when the photosensitive material is worn, it does not result immediately in a lowering of printing resistance provided that the charge generation and transport compounds are uniformly dispersed. In addition, the single-layer structure is easier in fabrications than double-layer structures. The drawbacks of the single-layer structure such as the sensitivity, charge characteristics and residual potential, are considered to result from a poor ozone resistance.

It should be noted that organic photosensitive materials of the positive charge type having a single-layer structure or a double-layer structure have been already proposed by the present applicant, for example, in U.S. patent application Ser. No. 551,538 (European Patent Application No. 90.307677.6).

SUMMARY OF THE INVENTION

It is accordingly an object of the invention to provide a method for making an organic photosensitive material of the positive charge type having a single-layer structure which can solve the problems involved in the prior art organic photosensitive materials.

It is another object of the invention to provide a method for making an organic photosensitive material with a single-layer structure which has high sensitivity, a good residual potential and charge characteristics comparable to known organic photosensitive materials of the double-layer structure.

It is a further object of the invention to provide a method for making an organic photosensitive material with a single-layer structure which has a good resistance to ozone with high durability.

It is a still further object of the invention to provide a method for making an organic photosensitive material having a double-layer structure which overcomes the disadvantages of the prior art.

It is yet another object of the invention to provide an organic photosensitive material of the positive charge type with a single-layer structure which is resistant to ozone and is thus high in durability with high sensitivity.

The present invention provides a method for making a photosensitive material which comprises:

(a) dissolving at least a part of X-type or $\tau$-type metal-free phthalocyanine in a solution of a resin binder in a solvent capable of dissolving at least a part of X-type or $\tau$ type metal-free phthalocyanine;

(b) applying the resultant solution onto a conductive support; and (c) drying the applied mixture to form a photosensitive layer on the conductive support.

Preferably, the binder resin should contain a polymer having vinylphenol units therein.

The method of the invention is based on the finding that when X-type or $\tau$-type metal-free phthalocyanine is at least partially dissolved in a solution in which a binder resin has been dissolved and the resultant solution is used to form a photosensitive layer, the layer exhibits good photosensitive characteristics when employed in positive charge systems.

More particularly, the amount of X-type or $\tau$-type phthalocyanine dissolved in a solvent depends greatly on the presence or absence and the type of binder resin. We have found that the phthalocyanine is more soluble when dispersed in a solution of binder resin in a solvent capable of dissolving at least a part of the phthalocyanine rather than in such a solvent alone. If the phthalocyanine is added to a solvent, not to a resin solution, part of the phthalocyanine is dissolved in the solvent whereupon the crystal form may be often converted into a more stable $\beta$-type crystal form.

By the dissolution of the phthalocyanine in a resin solution, the sensitivity becomes significantly higher than that of known positive charge-type organic photosensitive materials. The X-type or $\tau$-type phthalocyanine dissolved in this manner has the capability of charge transport although it has been considered as a charge generation agent. Moreover, unlike known charge transport materials, the X-type or $\tau$-type metal-free phthalocyanine has the ability of transporting positive charges. We have found that the transportability of positive charges is ascribed to X-type or $\tau$-type phthalocyanine which has been dispersed in the resin binder in a molecular state. On the other hand, the ability of charge generation is ascribed to the X-type or $\tau$-type phthalocyanine which has been dispersed in the resin binder in a particulate state. In the photosensitive material made according to the method of the invention, it is essential that X-type or $\tau$-type phthalocyanine be dispersed in a resin binder in a molecular state and a charge generation agent be dispersed in the resin binder in a particulate state. The charge generation agent which should be dispersed in a particulate state may be X-type or $\tau$-type metal-free phthalocyanine or other ordinary charge generation agents. The molecularly dispersed phthalocyanine and particulately dispersed charge generation agents may be formed either in a single layer or in separate layers.

In accordance with a more specific embodiment of the invention, there is also provided a photosensitive material for electrophotography which comprises a conductive support, and a photosensitive layer formed on the conductive support, the photosensitive layer being made of a composition which comprises X-type or $\tau$-type metal-free phthalocyanine dispersed in a resin binder having vinylphenol units therein. In this case, charge generation agents may be used in combination.

In this embodiment, the photosensitive layer may be in a single layer structure or in a double layer structure. In both structures, it is preferred that the binder resin having vinylphenol units is used. In view of the ease in making the photosensitive material, the single-layer structure is preferred. By the use of the resin binder having the vinylphenol units, the ozone resistance is remarkably improved, thus leading to stable charge potential, sensitivity and the like over a long term.

DETAILED DESCRIPTION AND EMBODIMENTS OF THE INVENTION

The respective steps of the method according to the invention are described.

In the first step, X-type and/or $\tau$-type metal-free phthalocyanine is dissolved in a solution of a resin binder in a solvent capable of dissolving at least a part of X-type and/or $\tau$-type metal-free phthalocyanine. The dissolution of the phthalocyanine in the resin solution includes one wherein the phthalocyanine and the resin binder are added to a solvent for both the phthalocyanine and the resin binder and are dissolved simultaneously. This is because the resin binder is more readily soluble than the phthalocyanine, eventually the phthalocyanine being dissolved in the resin solution. Preferably, the phthalocyanine is dissolved in a solution in which the resin binder has been preliminarily dissolved. The dissolution of the phthalocyanine in the resin solution to a an extent that it is molecularly dispersed in the solution takes a relatively long time of, for example, one to ten days under ordinary kneading or mixing conditions.

As stated before, when the phthalocyanine is initially dissolved in a solvent alone without addition of any resin binder, its crystal form may be converted into a more stable form. This is very unfavorable in view of the photosensitive characteristics.

X-type and/or $\tau$-type metal-free phthalocyanine used in the first step is of the following formula

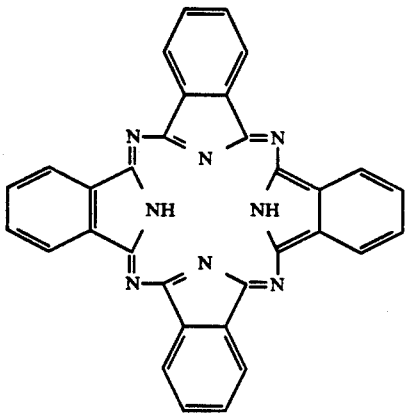

X-type metal-free phthalocyanine was developed by Xerox Co., Ltd. and was reported as having excellent electrophotographic characteristics. In U.S. Pat. No. 3,357,989, the X-type phthalocyanine is described with respect to its preparation, the relationship between the crystal form and electrophotographic characteristics and the structural analyses. According to this U.S. patent, X-type $H_2$-Pc (phthalocyanine) is prepared by subjecting $\beta$-type $H_2$-Pc prepared by a usual manner to treated with sulfuric acid to obtain $\alpha$-type $H_2$-Pc and then to ball milling over a long time. The crystal structure of X-type $H_2$-Pc is apparently different from those of $\alpha$ or $\beta$-type $H_2$-Pc. According to the X-ray diffraction pattern obtained with use of a CuK $\alpha$ line, the diffraction lines appear at 2 $\theta$=7.4°, 9.0°, 15.1°, 16.5°, 17.2°, 20.1°, 20.6°, 20.7°, 21.4°, 22.2°, 28.8°, 27.2°, 28.5 °and 30.3°. The most intense diffraction peak appears in the vicinity of 7.5° (corresponding to a lattice spacing, d, =11.8 angstroms). When this intensity is taken as 1, the intensity of the diffraction line in the vicinity of 9.1° (corresponding to a lattice spacing, d, =9.8 angstroms) is 0.66.

Aside from the above crystal forms, $\tau$-type metal-free phthalocyanine is also known. This phthalocyanine is obtained by subjecting to ball milling $\alpha$, $\beta$ and/or X-type crystals in an inert solvent along with a milling aid at a temperature of 5° to 10° C. for 20 hours. The X-ray diffraction pattern is substantially similar to that of the X type provided that the ratio of the diffraction peak intensity at about 7.5° and the diffraction peak intensity at about 9.1° is 1:0.8.

The X-type and/or $\tau$-type metal-free phthalocyanine is added to a resin solution or a solvent along with a resin binder and is dispersed therein. When the mixing under agitation is effected to a satisfactory extent, the phthalocyanine becomes finer in size and a part thereof is dissolved in the resin solution. The dissolution can be confirmed by an increase of the viscosity of the solution. In this state, the phthalocyanine is considered to exist in the solution partly in a particulately dispersed state and partly in a molecularly dispersed state. The molecularly dispersed phthalocyanine is considered to be different in crystal form from the particulately dispersed phthalocyanine. This molecularly dispersed phthalocyanine is assumed to function to transport charges. The X-ray diffraction pattern of the X-type phthalocyanine dissolved in a resin solution is apparently different from that of X-type $H_2$-Pc dissolved in a solvent alone and is also different from those of $\alpha$- and $\beta$-type metal-free phthalocyanines. More particularly, the X-ray diffraction pattern of the molecularly dispersed X-type metal-free phthalocyanine has the tendency that the diffraction lines over 2 $\theta$=21.4° disappear as compared with a X-ray diffraction pattern of X-type metal-free phthalocyanine and a diffraction pattern in the vicinity of 16.5° increases in intensity. The most appreciable variation in the X-ray diffraction pattern is that, of two diffraction lines in the vicinity of 7.5° (d=11.8 angstroms) and 9.1° (d=9.8 angstroms), only the diffraction line in the vicinity of 7.5° is selectively decreased. From this, at least a part of the X-type metal-free phthalocyanine which is considered to be molecularly dispersed in the resin solution is believed to be converted into a new crystal form.

The solvents capable of dissolving X-type and/or $\tau$-type phthalocyanine include, for example, nitrobenzene, chlorobenzene, dichlorobenzene, dichloromethane, trichloroethylene, chloronaphthalene, methylnaphthalene, benzene, toluene, xylene, tetrahydrofuran, cyclohexanone, 1,4-dioxane, N-methylpyrrolidone, carbon tetrachloride, bromobutane, ethylene glycol, sulforane, ethylene glycol monobutyl ether, acetoxyethoxyethane, pyridine, methyl cellosolve, isophorone and the like. The above solvents may be used singly or in combination.

The metal-free phthalocyanines are not dissolved in compounds such as acetone, cyclohexane, petroleum ether, nitromethane, methoxy ethanol, dimethylformamide, dimethylacetamide, acetonitrile, dimethylsulfoxide, ethyl acetate, isopropyl alcohol, diethyl ether, methyl ethyl ketone, ethanol, hexane, propylene carbonate, butylamine, water and the like. If these compounds are used as a solvent for resin binders, compounds capable of dissolving the phthalocyanines have to be used in combination.

The binder resins used in the present invention should preferably be ones which can be dissolved in the solvents for the phthalocyanine as mentioned above. The binder resins suitable for this purpose include polymers having vinylphenol units therein, polyesters, polyvinyl acetate, polyvinyl chloride, polyvinylidene chloride, polycarbonates, polyvinyl butyral, polyvinyl acetoacetal, polyvinyl formal, polyacrylonitrile, polymethyl methacrylate, polyacrylates, polyvinyl carbazoles, copolymers of the monomers used in the above-mentioned polymers, vinyl chloride/vinyl acetate/vinyl alcohol terpolymers, vinyl chloride/vinyl acetate/maleic acid terpolymers, ethylene/vinyl acetate copolymers, vinyl chloride/vinylidene chloride copolymers, cellulose polymers and mixtures thereof. Of these, the polymers having vinylphenol units therein are preferred especially in view of improvement in ozone resistance. Such polymers should preferably have OH groups Joined to an aromatic ring and have recurring units of the following formula

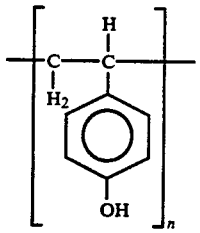

wherein n is an integer of not less than 10. The vinylphenol polymer may be copolymers with vinylphenol and styrene methyl methacrylate, hydroxyethylene methacrylate or the like. In addition, the vinylphenol polymer or copolymer may be used in combination with the above mentioned polymers or copolymers. In this case, the vinylphenol polymer or copolymer should preferably be contained in amounts of not less than 5 wt % of the total resin.

The phthalocyanine and the binder resin should preferably be mixed at a ratio by weight of 1:10 to 1:1.

The degree of mixing or kneading, and the mixing time and temperature depend on the types of solvent and resin binder. In order to obtain good characteristics as a photosensitive material, it is not favorable that the dispersion is insufficient or proceeds excessively. An optimum degree of the dispersion for the photosensitivity may be determined from a ratio of diffraction peak intensities at about 7.5° and about 9.1° ($I_{11.8}/I_{9.8}$). This ratio is preferably in the range of 1:1 to 0.1:1 for both X-type and $\tau$-type phthalocyanines.

It will be noted that when other types of charge generation agents such as other phthalocyanines, e.g. metal phthalocyanines, perylene compounds, thiapyrylium compounds, anthanthrone compounds, squalilium compounds, diazo compounds, cyanine compounds, trisazo pigments, and azulenium dyes are treated in the same manner as X-type and/or $\tau$-type metal-free phthalocyanine, similar results have not been obtained.

In the above, only X-type and/or $\tau$-type metal-free phthalocyanine is used in the first step but other types of charge generation compounds as mentioned above may be added in the first step. If other charge generating compound is used in combination, the combination of X-type and/or $\tau$-type metal-free phthalocyanine with the charge generation compounds and the resin binder are used at a mixing ratio by weight of 1:1 to 1:10. The X-type or $\tau$-type metal-free phthalocyanine should preferably be contained in an amount of not less than 10 wt % of other charge generating compound or compounds used.

Alternatively, a layer of a charge generation compound may be formed directly formed on a substrate, on which the layer of the phthalocyanine compound dispersed in a resin binder is formed. In this case, the photosensitive material has a double-layer structure. The charge generation layer is formed by dispersing a charge generating compound in a resin binder of the type as defined before by a simple mixing operation wherein the compound is dispersed only in a particulate state in the resin binder. In this case, it is preferred to use a vinylphenol polymer or copolymer as in order to ensure an improved ozone resistance.

Specific examples of other types of charge generation agents are shown below.

1. Metal phthalocyanines of the following formula

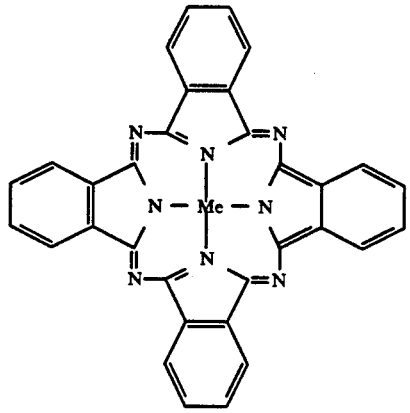

wherein Me represents a metal or a metal-containing group. Examples of the metallo-phthalocyanines useful in the present invention include copper phthalocyanine (which may be referred to simply as CuPc), lead phthalocyanine (PbPc), tin phthalocyanine (SnPc), silicon phthalocyanine (SiPc), vanadium phthalocyanine (VPc), chloroaluminium phthalocyanine (AlClPc), titanyl phthalocyanine (TiOPc), chloroindium phthalocyanine (InClPc), chlorogallium phthalocyanine (GaClPc) and the like. Of these, CuPc is preferred because of its better photosensitive characteristics than those of $\gamma$-, 68 -, $\beta$- and $\alpha$-$H_2Pc$.

2. Perylene compound of the following formula

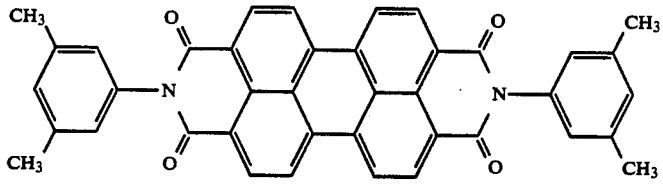

3. Perylene compound of the following formula

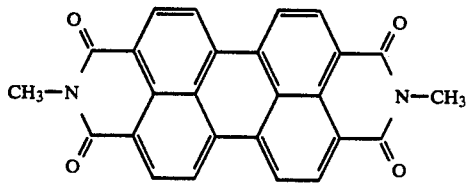

4. Compound of the following formula

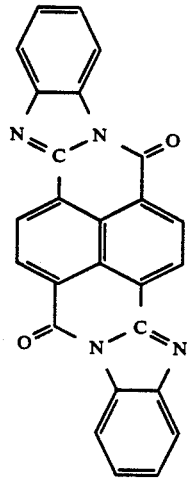
5. Anthanthrone compound of the following formula
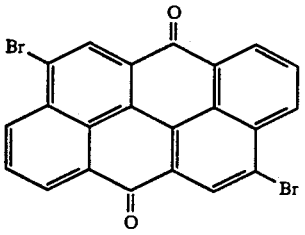
6. Thiapyrylium compound of the following formula
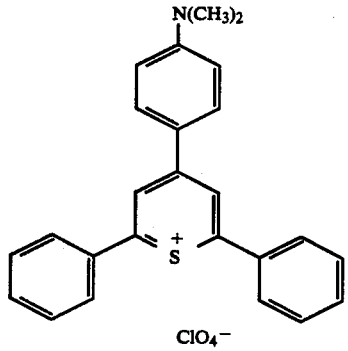
7. Compound of the following formula
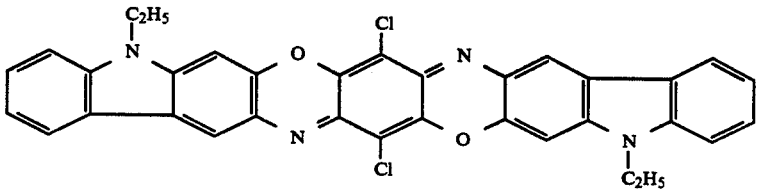
8. Squalilium compound of the following formula
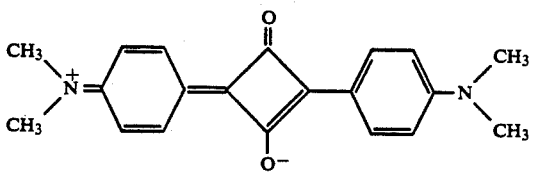
9. Cyanine compound of the following formula
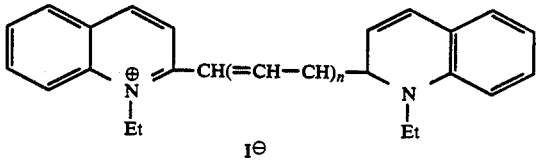
10. Squalilium compound of the following formula
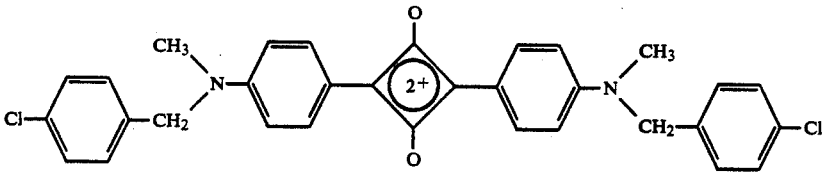
11. Azulenium dye of the following formula
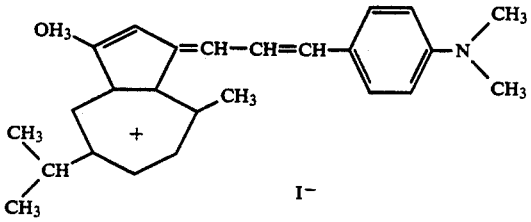
12. Trisazo compound of the following formula

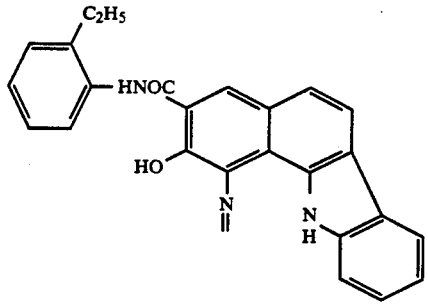

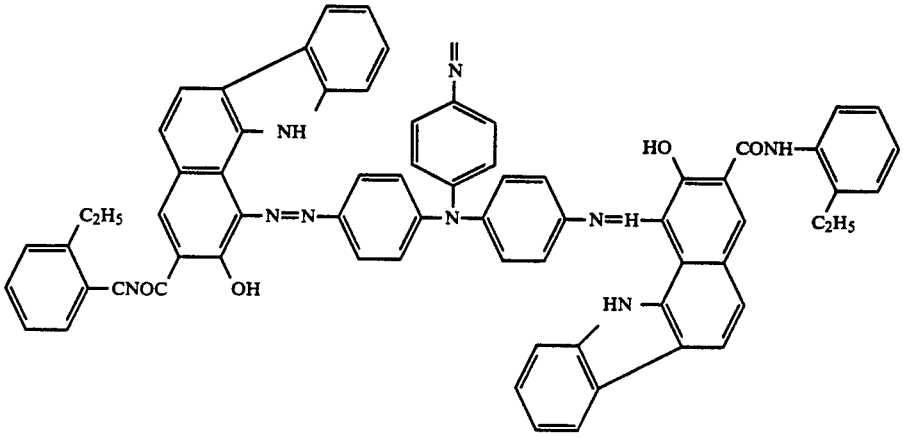

13. Diazo compound of the following formula

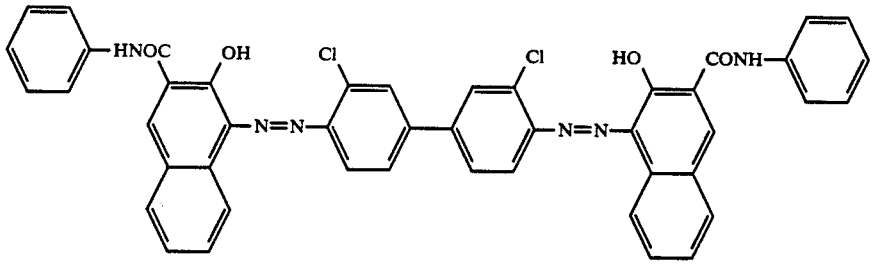

For the dissolution, the solid content in the solution should preferably be in the range of from 2 to 40 wt % in order to facilitate the agitation. The agitation may be effected by any known means such as using a agitation blade or by milling. When the solution is abruptly increased in viscosity during the agitation, the agitation may be stopped or continued to a desired extent.

In the second step, the dispersion or solution containing both X-type and/or $\tau$-type metal-free phthalocyanine is applied onto a conductive support by dipping, bar coating, gravure coating and the like coating techniques in a dry thickness of from 4 to 50 $\mu$m for the single-layer structure. When other type of charge generation layer is formed between the conductive support and the photoconductive layer, a charge generation compound is dispersed in a liquid medium at a concentration of 2 to 20 wt % for a time of from 1 to 4 hours and applied onto the support prior to the formation of the photoconductive layer. The conductive support used for this purpose is not critical and includes, for example, metal sheets such as Al sheets, and glass, paper or plastic sheets on which a metal is vapor deposited to form a conductive layer. The support may be in the form of drums, belts, sheets and the like.

In the third step, the applied layer is dried preferably in vacuum at a temperature of from 50° to 180° C. for a sufficient time to form a photoconductive layer on the support as usual.

The photosensitive materials obtained by the method of the invention exhibit good sensitivity to light with a wide wavelength range of from 600 to 800 nm.

The photosensitive materials of the invention are of the positive charge type. When they are negatively charged, the sensitivity is significantly reduced with a low charge potential. The photoconductive layer of the materials according to the invention is generally in a thickness of from 4 to 50 micrometers when a single-layer structure is used. If the double-layer structure is used, the charge generation layer has generally a thickness of from 0.2 to 2 micrometers and the layer having two dispersed phases has a thickness of from 5 to 40 micrometers. Moreover, the photosensitive materials of the invention may further comprise a protective layer made of insulating resins and formed on the photoconductive layer. Alternatively, a blocking layer may be further provided between the substrate and the photoconductive layer.

Then, a more specific embodiment of the invention is described. In accordance with the embodiment, there is provided a photosensitive material for electrophotography which comprises a conductive support and a photoconductive layer formed on the support. The photoconductive layer is made of a dispersion of X-type and/or τ-type metal-free phthalocyanine in a vinylphenol polymer or copolymer. The dispersion is prepared according to the procedure described with respect to the first step of the method of the invention. The vinylphenol polymer has preferably recurring units of the formula defined before. The copolymer is one which is obtained by copolymerization of vinylphenol and styrene, methyl methacrylate or hydroxyethylene methacrylate at a ratio by mole of 1:0.1 to 1:10. As stated before, the vinylphenol polymer or copolymers may be used singly or in combination or may be mixed with other polymers defined before. In this case, the amount of vinylphenol polymer or copolymer is used in the range of not less than 5 wt % of the total resin.

The ratio by weight of the phthalocyanine and the resin binder is in the range of from 1:10 to 1:1.

In the above embodiment, a single-layer structure wherein X-type and/or τ-type metal phthalocyanine is dispersed in the resin binder according to the procedure of the first step of the method of the invention is formed. Other types of charge generation compounds may be used or a double-layer structure may be formed as set out before in this embodiment.

The photosensitive materials are applicable to various types of printing systems including duplicating machines, printers, facsimiles and the like.

The photosensitive materials obtained by the invention are not limited to those described before. If necessary, for example, a protective layer made of an insulating resin may be formed on the photoconductive layer. Alternatively, a blocking layer may be provided between the support and the photoconductive layer.

The present invention is described in more detail by way of examples. Comparative examples are also described.

EXAMPLE 1

X-type metal free-phthalocyanine (Fastogen Blue 8120B, made by Dainippon Inks Co., Ltd.) and polyvinyl butyral (Eslex BM-2, available from Sekisui Chem. Ind. Co., Ltd.) were weighed at different ratios indicated in Table 1 and dissolved in tetrahydrofuran, followed by kneading under agitation to obtain solutions. Each solution was applied onto an aluminium drum by dipping and treated in vacuum at 120° C. for 1 hour to obtain a 10 to 20 μm thick photoconductive layer.

The thus obtained photosensitive materials were each subjected to measurement of photosensitivity by the use of Paper Analyzer Model EPA-8100, made by Kawaguchi Denki K.K., in which white light from tungsten was irradiated on the material to measure a photosensitivity by positive charge (half-life exposure, $E_{\frac{1}{2}}$) and also a photosensitivity after repetition of 1000 exposure cycles. In addition, a wavelength characteristic in a range of 400 to 1000 nm was also measured. The results are shown in Table 1.

TABLE 1

| X-Pc | PVB | Charge Potential (V) | Photosensitivity: Initial Half-life Exposure (lux · sec) | Photosensitivity: Half-life Exposure After 1000 Cycles (lux · sec) | Wavelength Characteristic ($cm^2/\mu J$) |
|---|---|---|---|---|---|
| 1 | 0.8 | 200 | 0.6 | 0.8 | 2.9 |
| 1 | 1 | 300 | 0.6 | 0.7 | 2.8 |
| 1 | 1.5 | 350 | 0.7 | 0.7 | 2.6 |
| 1 | 2 | 410 | 0.8 | 0.8 | 2.5 |
| 1 | 3 | 530 | 1.0 | 0.9 | 2.4 |
| 1 | 4 | 600 | 1.0 | 1.0 | 2.2 |
| 1 | 5 | 700 | 1.5 | 1.4 | 1.8 |
| 1 | 8 | 910 | 1.8 | 2.0 | 1.8 |
| 1 | 10 | 1200 | 2.5 | 2.5 | 1.2 |
| 1 | 20 | 2000 | 3.8 | 5.2 | 0.6 |
| 1 | 50 | >2000 | >10 | >10 | >0.1 |

X-Pc: X-type phthalocyanine
PVB: polyvinyl butyral

As will be apparent from the above results, the ratio by weight of the X-Pc and PVB is appropriately in the range of 1:1 to 1:10, within which the charge characteristic and the photosensitive characteristics are both good.

EXAMPLE 2

The general procedure of Example 1 was repeated except that there was used, instead of tetrahydrofuran, toluene/methyl ethyl ketone, N-methylpyrrolidone or chlorobenzene. Similar results are obtained.

Comparative Example 1

For comparison, the general procedure of Example 1 as repeated except that a mixed solvent of acetone and dimethylformamide was used and certain mixing ratios of X-Pc and PVB were used as indicated in Table 2 below. It will be noted that acetone and dimethylformamide are both able to dissolve PVB but cannot dissolve X-Pc. Accordingly, all X-Pc used is mixed in the resin binder in a particulate form and it is considered that any X-Pc dispersed in a molecular state is not present.

The results are shown in Table 2 below.

TABLE 2

| X-Pc | PVB | Charge Potential (V) | Photosensitivity: Initial Half-life Exposure (lux · sec) | Photosensitivity: Half-life Exposure After 1000 Cycles (lux · sec) | Wavelenth Characteristic ($cm^2/\mu J$) |
|---|---|---|---|---|---|
| 1 | 0.8 | 80 | 5.6 | 6.8 | 0.1 |
| 1 | 1 | 130 | 5.2 | 7.7 | 0.08 |
| 1 | 2 | 250 | 8.7 | 9.2 | 0.06 |
| 1 | 5 | 500 | 10.6 | 12.8 | 0.04 |
| 1 | 10 | 630 | 21.5 | 20.9 | 0.02 |
| 1 | 20 | >2000 | >25.0 | >30.0 | <0.01 |

As will be apparent from the above results, the photosensitivity, $E_{\frac{1}{2}}$, is considerably poorer than those in Table 1. This will give evidence that it is necessary in the present invention that part of X-Pc be dispersed in the resin binder in a molecular state.

EXAMPLE 3

τ-Type metal free-phthalocyanine (hereinafter referred to simply as τ-Pc, Liophoton THP, available from Toyo Inks Co., Ltd.) and polyvinyl butyral (Eslex BM-2) were weighed at different ratios indicated in Table 3 and dissolved in tetrahydrofuran, followed by kneading under agitation to obtain solutions. Each solution was applied onto an aluminium drum by dipping and treated in vacuum at 120° C. for 1 hour to obtain a 10 to 20 μm thick photoconductive layer.

The thus obtained photosensitive materials were each subjected to measurement of photosensitivity in the same manner as in Example 1. The results are shown in Table 3.

TABLE 3

| τ-Pc | PVB | Charge Potential (V) | Photosensitivity: Initial Half-life Exposure (lux · sec) | Photosensitivity: Half-life Exposure After 1000 Cycles (lux · sec) | Wavelength Characteristic ($cm^2/\mu J$) |
|---|---|---|---|---|---|
| 1 | 0.8 | 180 | 0.7 | 0.8 | 2.9 |
| 1 | 1 | 300 | 0.8 | 0.7 | 2.5 |
| 1 | 1.5 | 320 | 1.0 | 0.9 | 2.5 |
| 1 | 2 | 460 | 1.1 | 1.0 | 2.3 |
| 1 | 3 | 570 | 1.2 | 1.2 | 2.2 |
| 1 | 4 | 620 | 1.2 | 1.3 | 2.0 |
| 1 | 5 | 820 | 1.6 | 1.9 | 1.8 |
| 1 | 8 | 920 | 1.8 | 1.9 | 1.5 |
| 1 | 10 | 1400 | 2.6 | 2.7 | 1.1 |
| 1 | 20 | 2000 | 4.7 | 5.6 | 0.4 |
| 1 | 50 | >2000 | >10 | >10 | >0.1 |

From the above results, it will be seen that τ-Pc is excellent in the photosensitive characteristics similar to X-Pc.

EXAMPLE 4

X-type metal-free phthalocyanine was mixed with various types of binder resins at a mixing ratio by weight of 1:4 and each mixture was dissolved in tetrahydrofuran at a solid content of 20 wt %, followed by kneading under agitation. Each solution was applied onto an aluminium drum by dipping and treated in vacuum at 120° C. for 1 hour to obtain a 10 to 20 μm thick photoconductive layer.

The thus obtained photosensitive materials were each subjected to measurement of photosensitivity in the same manner as in Example 1. The results are shown in Table 4.

TABLE 4

| polymer | Charge Potential (V) | Photosensitivity: Initial Half-life Exposure (lux · sec) | Photosensitivity: Half-life Exposure After 1000 Cycles (lux · sec) | Wavelength Characteristic ($cm^2/\mu J$) |
|---|---|---|---|---|
| polyester | 780 | 1.1 | 1.2 | 1.9 |
| vinyl chloride/vinyl acetate copolymer | 600 | 1.6 | 1.5 | 1.8 |
| vinyl chloride/vinyl acetate/vinyl alcohol terpolymer | 630 | 1.4 | 1.5 | 1.8 |
| vinyl chloride/vinyl acetate/maleic acid terpolymer | 770 | 1.2 | 1.4 | 2.0 |
| polycarbonate | 620 | 1.4 | 1.4 | 2.0 |

The results reveal that good characteristics are obtained irrespective of the type of polymer provided that the polymers are dissolved in the solvent.

EXAMPLE 5

The photosensitive material obtained in Example 1 wherein a ratio by weight of X-Pc an PVB was 1:4 was subjected to a continuous printing test. The test was effected using A-4 size test paper sheets. As a result, it was found that the material was stable for the continuous running test of 30,000 sheets. Thus, the printing resistance is better than known single-layer or double-layer photosensitive materials.

EXAMPLE 6

X-type metal-free phthalocyanine (X-Pc) and PVB (BM-2) which was dissolved in isopropyl alcohol were weighed at a ratio by weight of 1:1 and mixed sufficiently. The solution was applied onto an aluminium drum by dipping and dried in vacuum at 120° C. for 1 hour to form a 2 to 5 micrometer thick charge generation layer. Since the phthalocyanine was not dissolved in the alcohol, it was considered to exist in the layer in the form of particles.

Thereafter, X-Pc and a polyester (Vylon 200, available from Toyobo Co., Ltd. and hereinafter referred to simply as PET) were dissolved in tetrahydrofuran at different ratios. The resultant solutions were each applied onto the charge generation layer to form a charge transport layer in a thickness of from 10 to 20 μm.

The resultant photosensitive materials were subjected to measurement in the same manner as in Example 1. The results are shown in Table 5.

TABLE 5

| X-Pc | PET | Charge Potential (V) | Photosensitivity: Initial Half-life Exposure (lux · sec) | Photosensitivity: Half-life Exposure After 5000 Cycles (lux · sec) | Wavelenth Characteristic ($cm^2/\mu J$) |
|---|---|---|---|---|---|
| 1 | 0.8 | 200 | 0.7 | 0.8 | 2.7 |
| 1 | 1 | 220 | 0.7 | 0.7 | 2.6 |
| 1 | 1.5 | 310 | 0.8 | 0.9 | 2.4 |
| 1 | 2 | 410 | 0.8 | 0.8 | 2.4 |
| 1 | 3 | 530 | 1.0 | 1.1 | 2.4 |
| 1 | 4 | 600 | 1.6 | 1.6 | 2.0 |
| 1 | 5 | 700 | 1.6 | 1.6 | 1.8 |
| 1 | 8 | 910 | 1.8 | 2.0 | 1.8 |
| 1 | 10 | 1200 | 2.5 | 2.5 | 1.8 |
| 1 | 20 | 2000 | 3.5 | 3.2 | 1.6 |
| 1 | 50 | >2000 | >10 | >10 | >1.0 |

As will be apparent from the above results, the method of the invention is effective in making a double-layer photosensitive material. The ratio by weight of X-Pc and PET is preferably from 1:2 to 1:20, within which charge and photosensitive characteristics are good.

EXAMPLE 7

In the same manner as in Example 5, a double-layer photosensitive material of the positive charge type was made using τ-type metal-free phthalocyanine (Liophoton THP). The results were similar to those in the case of X-Pc.

EXAMPLE 8

X-Pc and each of various binder resins were mixed at a mixing ratio by weight of 1:5 and dissolved in tetrahydrofuran, followed by sufficient kneading under agitation. The respective solutions were applied onto an the charge generation layer formed in the same manner as in Example 6, followed by drying in vacuum at 120° C. for 1 hour to form a photoconductive layer with a thickness of 10 to 20 μm.

The thus obtained photosensitive materials were each subjected to measurement in the same manner as in Example 1. The results are shown in Table 6.

TABLE 6

| Polymer | Charge Potential (V) | Photosensitivity (lux · sec) | Photosensitivity after 1000 Cycles (lux · sec) | Wavelength Characteristic ($cm^2/\mu J$) |
|---|---|---|---|---|
| polyester | 780 | 1.6 | 1.6 | 1.8 |
| vinyl chloride/vinyl acetate copolymer | 600 | 1.6 | 1.5 | 2.0 |
| vinyl chloride/vinyl acetate/vinyl alcohol terpolymer | 630 | 1.5 | 1.5 | 2.1 |
| vinyl chloride/vinyl acetate/maleic acid terpolymer | 770 | 1.3 | 1.4 | 2.2 |
| polycarbonate | 620 | 1.6 | 1.5 | 2.1 |

Thus, the method of the invention is effective irrespective of the type of polymer used as the charge transport layer.

EXAMPLE 9

In the same manner as in Example 6 using various charge generation compounds indicated before, there were formed charge generation layers on the drum. Thereafter, the general procedure of Example 1 was repeated except that X-Pc and PET were mixed at a ratio by weight of 1:5 to form a charge transport layer on the respective charge generation layers, followed by evaluation of the characteristics. The results are shown in Table 7 below.

TABLE 7

| Charge Generation Compound No. | Charge Potential (V) | Photosensitivity (lux · sec) | Photosensitivity after 1000 Cycles (lux · sec) |
|---|---|---|---|
| copper phthalocyanine | 800 | 1.4 | 1.4 |
| 2 | 820 | 1.6 | 1.8 |
| 3 | 720 | 2.0 | 2.2 |
| 4 | 660 | 1.6 | 1.8 |
| 5 | 590 | 2.5 | 2.8 |
| 6 | 800 | 1.6 | 1.8 |
| 7 | 740 | 1.9 | 2.0 |
| 9 | 810 | 2.2 | 2.2 |
| 11 | 480 | 1.7 | 1.8 |
| 12 | 800 | 2.1 | 2.4 |
| 13 | 760 | 2.0 | 2.0 |

The above results reveal that the method of the invention is effective in making a double-layer structure wherein various charge generation compounds are useful.

EXAMPLE 10

The photosensitive material obtained in Example 6 using X-Pc and PET at a ratio by weight of 1:5 in the charge transport layer was selected for a continuous printing resistance test. The test was conducted using A4-size paper sheets, from which it was found that the material was stable when 30,000 sheets were continuously printed. Thus, the photosensitive material obtained by the method of the invention is better in the printing resistance than known positive charge-type reversed double-layer structure photosensitive materials.

EXAMPLE 11

X-Pc, a trisazo compound No. 12 indicated before, which was prepared by a procedure set forth in Ricoh Technical Report No. 8, Nov. 14 (1982), and Polyvinyl butyral (BM-2) were mixed at different ratios and dissolved in tetrahydrofuran, followed by sufficient kneading. The resultant solutions were each applied onto an aluminium drum and treated in vacuum at 120° C. for 1 hour to obtain a photoconductive layer with a thickness of 10 to 20 μm.

The respective photosensitive materials were each subjected to measurement of photosensitive characteristics in the same manner as in Example 1. The results are shown in Table 8.

TABLE 8

| X-Pc | Charge Generation Compound 12 | PVB | Charge Potential (V) | Initial Photosensitivity (lux · sec) | Photosensitivity After 1000 Cycles (lux · sec) |
|---|---|---|---|---|---|
| 0.2 | 0.4 | 0.5 | 200 | 0.9 | 1.0 |
| 0.2 | 0.4 | 1 | 300 | 1.2 | 1.2 |
| 0.2 | 0.4 | 1.2 | 420 | 1.4 | 1.6 |
| 0.2 | 0.4 | 1.8 | 600 | 1.6 | 1.8 |
| 0.2 | 0.4 | 3.0 | 710 | 2.0 | 2.3 |
| 0.2 | 0.4 | 6.0 | 820 | 2.6 | 2.5 |
| 0.2 | 0.4 | 10.0 | 1500 | 4.6 | 4.9 |
| 0.01 | 0.59 | 1.8 | 750 | 5.0 | 5.7 |
| 0.02 | 0.58 | 1.8 | 700 | 4.6 | 5.8 |
| 0.05 | 0.55 | 1.8 | 660 | 3.3 | 3.7 |
| 0.1 | 0.5 | 1.8 | 670 | 1.9 | 1.8 |
| 0.2 | 0.4 | 1.8 | 600 | 1.6 | 1.8 |
| 0.3 | 0.3 | 1.8 | 580 | 1.2 | 1.0 |
| 0.4 | 0.2 | 1.8 | 400 | 1.2 | 0.9 |
| 0.5 | 0.1 | 1.8 | 370 | 1.2 | 1.0 |

As will be apparent from the above results, the ratio of the total of X-Pc and the charge generation compound and PVB is preferably in the range of from 1:1 to 1:10, within which good charge characteristic and sensitivity are obtained. Moreover, the ratio by weight of X-Pc and the additional charge generation compound is preferably in the range of from 1:10 to 5:1. This is why the content of X-Pc and/or τ-Pc is defined as being not less than 10 wt % of other charge generation compound.

Comparative Example 2

The general procedure of Example 11 was repeated except that a mixed solvent of acetone and dimethylformamide was used instead of tetrahydrofuran and certain mixing ratios indicated in Table 9 were used. As stated before, acetone and dimethylformamide both do not dissolve X-Pc but dissolve PVB. In this system, X-Pc was dispersed in the PVB in a particulate state. The results are shown in Table 9.

TABLE 9

| X-Pc | Charge Generation Compound 12 | PVB | Charge Potential (V) | Initial Photosensitivity (lux · sec) | Photosensitivity After 1000 Cycles (lux · sec) |
|---|---|---|---|---|---|
| 0.2 | 0.4 | 1.0 | 700 | 6.6 | 6.8 |
| 0.2 | 0.4 | 1.8 | 800 | 8.6 | 9.7 |
| 0.2 | 0.4 | 3.0 | 1200 | 10.0 | 10.8 |

TABLE 9-continued

| X-Pc | Charge Generation Compound 12 | PVB | Charge Potential (V) | Initial Photosensitivity (lux · sec) | Photosensitivity After 1000 Cycles (lux · sec) |
|---|---|---|---|---|---|
| 0.2 | 0.4 | 6.0 | 2000 | 18.6 | 17.5 |
| 0.1 | 0.5 | 1.8 | 200 | 9.6 | 10.9 |
| 0.3 | 0.3 | 1.8 | 300 | 5.6 | 7.7 |

As will be apparent from the above results, the photosensitivity, $E_{\frac{1}{2}}$ by positive charge is considerably poorer than those in Table 8.

EXAMPLE 12

The general procedure of Example 11 was repeated except that τ-Pc was used instead of X-Pc and the ratios were as indicated in Table 10. The results are shown in Table 10.

TABLE 10

| τ-Pc | Charge Generation Compound 12 | PVB | Charge Potential (V) | Initial Photosensitivity (lux · sec) | Photosensitivity After 1000 Cycles (lux · sec) |
|---|---|---|---|---|---|
| 0.2 | 0.4 | 1 | 350 | 1.4 | 1.5 |
| 0.2 | 0.4 | 1.2 | 520 | 1.6 | 1.6 |
| 0.2 | 0.4 | 1.8 | 700 | 1.8 | 2.0 |
| 0.2 | 0.4 | 3.0 | 730 | 2.2 | 2.3 |
| 0.2 | 0.4 | 6.0 | 980 | 2.9 | 3.0 |
| 0.02 | 0.58 | 1.8 | 620 | 4.2 | 5.0 |
| 0.05 | 0.55 | 1.8 | 600 | 3.6 | 3.4 |
| 0.1 | 0.5 | 1.8 | 720 | 2.0 | 2.2 |
| 0.2 | 0.4 | 1.8 | 650 | 2.0 | 1.8 |
| 0.3 | 0.3 | 1.8 | 500 | 1.8 | 1.7 |
| 0.4 | 0.2 | 1.8 | 500 | 1.8 | 1.7 |

The above results reveal that τ-type phthalocyanine exhibit substantially the same photosensitive characteristics as X-type phthalocyanine.

EXAMPLE 13

X-Pc, charge generation compound No. 12 indicated before and each of various binder resins were mixed at mixing ratios by weight of 0.2:0.4:1.8 and dissolved in tetrahydrofuran, followed by sufficient kneading under agitation. The respective solutions were applied onto an the charge generation layer formed in the same manner as in Example 6, followed by drying in vacuum at 120° C. for 1 hour to form a photoconductive layer with a thickness of 10 to 20 μm.

The thus obtained photosensitive materials were each subjected to measurement in the same manner as in Example 1. The results are shown in Table 11.

TABLE 11

| Polymer | Charge Potential (V) | Photosensitivity (lux · sec) | Photosensitivity after 1000 Cycles (lux · sec) |
|---|---|---|---|
| polyester | 880 | 1.8 | 2.0 |
| vinyl chloride/vinyl acetate copolymer | 570 | 2.0 | 2.4 |
| vinyl chloride/vinyl acetate/vinyl alcohol terpolymer | 630 | 2.4 | 2.2 |
| vinyl chloride/vinyl acetate/maleic acid terpolymer | 770 | 1.8 | 2.4 |
| polycarbonate | 620 | 2.0 | 1.9 |

Thus, the method of the invention is effective irrespective of the type of polymer.

EXAMPLE 14

X-Pc, each of charge generation compounds selected from those indicated before as Compound Nos. 1 to 13, and PVB were mixed and dissolved at ratios by weight of 0.2:0.4:1.8, followed by sufficient kneading. The resultant solutions were each applied onto an aluminium drum by dipping in vacuum at 120° C. for 1 hour to form a 10 to 20 μm thick photoconductive layer.

The thus obtained photosensitive materials were evaluated in the same manner as in Example 1. The results are shown in Table 12.

TABLE 12

| Charge Generation Compound No. | Charge Potential (V) | Photosensitivity (lux · sec) | Photosensitivity after 1000 Cycles (lux · sec) |
|---|---|---|---|
| copper phthalocyanine | 700 | 1.4 | 1.4 |
| 2 | 850 | 2.0 | 2.1 |
| 3 | 900 | 3.1 | 3.1 |
| 4 | 710 | 2.2 | 2.2 |
| 5 | 620 | 2.4 | 2.0 |
| 6 | 500 | 2.0 | 2.5 |
| 7 | 750 | 1.8 | 2.0 |
| 9 | 550 | 1.5 | 1.8 |
| 10 | 680 | 2.0 | 2.6 |
| 13 | 710 | 2.6 | 3.5 |

As will be apparent from the above results, the method of the invention is applicable to combinations of X-Pc and known charge generation compounds. Since the charge generation compounds have, respectively, the charge generation ability with respect to light with an inherent wavelength, so that the photosensitive materials using such compounds are, respectively, sensitive to the inherent wavelengths.

EXAMPLE 15

The photosensitive material which was prepared using X-Pc, charge generation compound No. 12 and PVB at ratios by weight of 0.2:0.4:1.8 in the same manner as in Example 1 was subjected to a continuous printing resistance test. The test was conducted using A4-size paper sheets, from which it was found that the material was stable when 30,000 sheets were continuously printed. Thus, the photosensitive material obtained by the method of the invention is better in the printing resistance than known positive charge-type single-layer structure or reversed double-layer structure photosensitive materials.

In the following examples, the excellence of vinylphenol resins as the resin binder is described.

EXAMPLE 16

X-type metal-free phthalocyanine and p-vinylphenol resin (Maruka Lycur-M, available from Maruzen Petrochemical Co., Ltd.) used as a resin binder were dissolved in tetrahydrofuran at a mixing ratio by weight of 1:4, followed by mixing in a ball mill. The resultant solution was applied onto an aluminium drum by dipping and dried in air at 60° C. for 1 hour to form a photoconductive layer with a single-layer structure having a thickness of from 15 to 20 μm.

The photosensitive material was subjected to measurement of photosensitive characteristics by positively charging the material and irradiating with white light from a tungsten lamp by the use of Paper Analyzer EPA-8100 to determine a photosensitivity (half-life exposure, $E_{\frac{1}{2}}$) and a residual potential, Vr. Thereafter, the Paper Analyzer was charged with ozone produced from an ozone generator (Clean Load 300, available from Simon Co., Ltd.) to an ozone concentration of not less than 5 ppm and the above measurement was repeated. The results are Shown in Table 13.

TABLE 13

| Example 16 | Initial Characteristics | In Ozone |
|---|---|---|
| Charge Potential (V) | 930 | 930 |
| Photosensitivity (lux · sec) | 2.3 | 2.2 |
| Attenuation in the dark (%) | 97.5 | 97.5 |
| after five seconds | | |
| Residual Potential (V) | 5 | 6 |

EXAMPLE 17

X-type metal-free phthalocyanine, p-vinylphenol resin (Maruka Lycur-M) and a polymer of the following formula with a rate of substitution of Br of 50% (FOC-10, available from Fuji Pharmaceutical Co., Ltd.) were dissolved in tetrahydrofuran at ratios by weight of 1:2:2, followed by mixing in a ball mill.

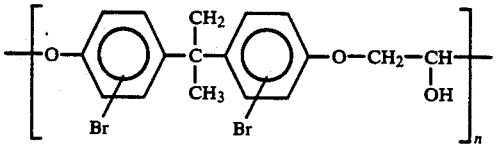

The resultant solution was applied onto an aluminium drum by dipping and dried in air at 60° C. for 1 hour to obtain a photoconductive layer having a single-layer structure with a thickness of from 15 to 20 μm.

The photosensitive material was subjected to measurement in the same manner as in Example 16. The results are shown in Table 14.

TABLE 14

| Example 17 | Initial Characteristics | In Ozone |
|---|---|---|
| Charge Potential (V) | 850 | 850 |
| Photosensitivity (lux · sec) | 2.0 | 2.1 |
| Attenuation in the dark (%) | 97.0 | 97.0 |
| after five seconds | | |
| Residual Potential (V) | 12 | 10 |

Comparative Example 3

X-type metal-free phthalocyanine and the resin, FOC-10, used in Example 17 were dissolved in tetrahydrofuran at a mixing ratio of 1:4 and mixed in a ball mill. The resultant solution was applied onto an aluminium drum by dipping and dried in air at 60° C. for 1 hour to obtain a photoconductive layer with a single-layer structure in a thickness of 15 to 20 μm.

The photosensitive material was subjected to measurement in the same manner as in Example 16. The results are shown in Table 15.

TABLE 15

| Comparative Example 3 | Initial Characteristics | In Ozone |
|---|---|---|
| Charge Potential (V) | 830 | 620 |
| Photosensitivity (lux · sec) | 2.1 | 3.5 |
| Attenuation in the dark (%) | 98.0 | 52.3 |

TABLE 15-continued

| Comparative Example 3 | Initial Characteristics | In Ozone |
|---|---|---|
| after five seconds | | |
| Residual Potential (V) | 8 | 8 |

The comparison of the results of Tables 13 to 15 reveal that the photosensitive materials of the invention are significantly improved in the ozone resistance over the material for comparison.

What is claimed is:

1. A method for making an organic photoconductive material which comprises:
   (a) dissolving at least a part of X-type and/or τ-type metal-free phthalocyanine in a solution of a resin binder comprising a vinylphenol polymer in a solvent capable of dissolving at least a part of X-type and/or τ-type metal-free phthalocyanine;
   (b) applying the resultant solution onto a conductive support; and
   (c) drying the applied mixture to form a photosensitive layer on the conductive support.

2. The method according to claim 1, wherein said X-type and/or τ-type metal-free phthalocyanine is added to said solvent simultaneously with the resin binder.

3. The method according to claim 1, wherein said X-type and/or τ-type metal-free phthalocyanine is added to said solvent in which the resin binder has been dissolved.

4. The method according to claim 1, wherein a charge generation compound is further added in step (a).

5. The method according to claim 1, further comprising, prior to step (a), forming a layer of a charge generation compound on said conductive support and the photosensitive layer is formed on the layer of the charge generation compound whereby a double-layer structure is formed on said conductive support.

6. The method according to claim 1, wherein said vinylphenol polymer has recurring units of the following general formula

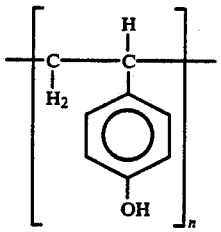

wherein n is an integer of not less than 10.

7. The method according to claim 1, wherein said resin binder consists essentially of said vinylphenol polymer.

8. The method according to claim 1, wherein said resin binder comprises a copolymer of vinylphenol and styrene, methyl methacrylate or hydroxyethylene methacrylate.

9. The method according to claim 8, wherein said resin binder consists essentially of a copolymer of vinylphenol and styrene, methyl methacrylate or hydroxyethylene methacrylate.

10. An organic photoconductor material for electrophotography which comprises a conductive support, and a photosensitive layer formed on the conductive support, said photosensitive layer being made of a composition which comprises X-type and/or τ-type metal-free phthalocyanine dispersed in a resin binder comprising a vinylphenol polymer.

11. The photoconductive material according to claim 10, wherein said X-type and/or τ-type metal-free phthalocyanine is dispersed in said resin binder partly in a molecular state and partly in a particulate state.

12. The photoconductive material according to claim 10, wherein said resin binder consists essentially of the vinylphenol polymer.

13. The photoconductive material according to claim 10, wherein said vinylphenol polymer has recurring units of the following general formula

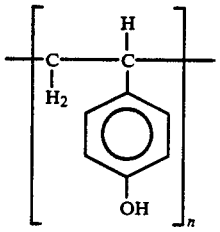

wherein n is an integer of not less than 10.

14. The photoconductive material according to claim 10, wherein said resin binder comprises a copolymer of vinylphenol and styrene, methyl methacrylate or hydroxyethylene methacrylate.

15. The photoconductive material according to claim 14, wherein said resin binder consists essentially of the copolymer.

16. The photoconductive material according to claim 10, wherein said X-type and/or τ-type metal-free phthalocyanine and said resin binder are mixed at a ratio by weight of 1:10 to 1:1

17. The photoconductive material according to claim 10, wherein said photosensitive layer further comprises a charge generation compound dispersed in said resin binder.

18. The photoconductive material according to claim 17, wherein said photosensitive layer comprises said X-type and/or τ-type metal-free phthalocyanine and said charge generation compound at a ratio by weight of 1:10 to 5:1.

19. The photoconductive material according to claim 10, further comprises a layer of a charge generation compound formed between said conductive support and said photosensitive layer whereby a double-layer structure is formed.

20. The photoconductive material according to claim 19, wherein said layer of the charge generation compound comprises a resin binder having a vinylphenol structure therein.

21. The photoconductive material according to claim 20, wherein said layer consists essentially of the resin binder having a vinylphenol structure.

22. The photoconductive material according to claim 21, wherein said vinylphenol polymer has recurring units of the following general formula

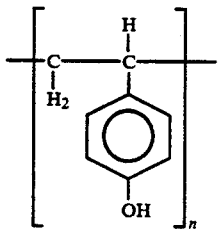

wherein n is an integer of not less than 10.

23. The photosensitive material according to claim 20, wherein said resin binder comprises a copolymer of vinylphenol and styrene, methyl methacrylate or hydroxyethylene methacrylate.

* * * * *